US008828215B2

(12) United States Patent
Blawert et al.

(10) Patent No.: US 8,828,215 B2
(45) Date of Patent: Sep. 9, 2014

(54) PROCESS FOR PRODUCING A COATING ON THE SURFACE OF A SUBSTRATE BASED ON LIGHTWEIGHT METALS BY PLASMA-ELECTROLYTIC OXIDATION

(75) Inventors: Carsten Blawert, Lauenburg (DE); Daniel Hoche, Hamburg (DE); Yuanding Huang, Geesthacht (DE); Jun Liang, Lanzhou (CN)

(73) Assignee: Helmholtz-Zentrum Geesthacht Zentrum für Material-und Küstenforschung GmbH, Geesthacht (DE)

( * ) Notice: Subject to any disclaimer, the term of this patent is extended or adjusted under 35 U.S.C. 154(b) by 93 days.

(21) Appl. No.: 13/438,418

(22) Filed: Apr. 3, 2012

(65) Prior Publication Data

US 2012/0261266 A1 Oct. 18, 2012

(30) Foreign Application Priority Data

Apr. 14, 2011 (DE) ..... 10 2011 007 424

(51) Int. Cl.

| | |
|---|---|
| ***C25D 11/00*** | (2006.01) |
| ***C25D 9/00*** | (2006.01) |
| ***C25D 15/00*** | (2006.01) |
| ***C25D 11/02*** | (2006.01) |
| ***C25D 11/34*** | (2006.01) |
| ***C25D 11/30*** | (2006.01) |
| ***C25D 11/06*** | (2006.01) |

(52) U.S. Cl.

CPC ..... *C25D 11/026* (2013.01); *C25D 15/00* (2013.01); *C25D 11/34* (2013.01); *C25D 11/30* (2013.01); *C25D 11/06* (2013.01)

USPC ..... 205/333; 205/321; 205/322; 205/323

(58) Field of Classification Search

USPC ..... 205/316–333

See application file for complete search history.

(56) References Cited

U.S. PATENT DOCUMENTS 2,650,975 A * 9/1953 Dorst ..... 338/263
4,066,516 A 1/1978 Sato (Continued)

FOREIGN PATENT DOCUMENTS

DE 156003 3/1984
DE 4200027 A1 7/1993

(Continued)

OTHER PUBLICATIONS

Blawert et al., Advanced Engineering Materials 2006,8, No. 6, pp. 511 to 533.

(Continued)

*Primary Examiner* — James Lin
*Assistant Examiner* — Brian W Cohen
(74) *Attorney, Agent, or Firm* — Marshall, Gerstein & Borun LLP

(57) ABSTRACT

The present invention relates to a process for producing a coating on the surface of a substrate by plasma-electrolytic oxidation. Improved corrosion protection for lightweight metals, in particular for magnesium or magnesium alloys, is achieved by the process. Furthermore, biocompatible protective layers can also be produced on these materials, with the option of controlling degradation of the substrate. The layers are amorphous. They are produced by plasma-electrolytic oxidation in which the substrate is dipped as electrode together with a counterelectrode into an electrolyte liquid and a sufficient electric potential for generating spark discharges at the surface of the substrate is applied, wherein the electrolyte comprises clay particles dispersed therein. Substrates can therefore be any machine components, automobile components, railroad components, aircraft components, ships' components, etc., or bioimplants such as bone replacement materials or medical bone screws made of a lightweight metal such as magnesium or a magnesium alloy.

12 Claims, 2 Drawing Sheets

(56) References Cited

U.S. PATENT DOCUMENTS

| | | | | |
|---|---|---|---|---|
| 6,896,785 | B2 * | 5/2005 | Shatrov et al. | 205/109 |
| 6,919,012 | B1 * | 7/2005 | Bucar | 205/107 |
| 2003/0070936 | A1 | 4/2003 | Dolan | |
| 2003/0194498 | A1 | 10/2003 | Hayashi et al. | |
| 2007/0207267 | A1 * | 9/2007 | Laube | 427/230 |
| 2011/0177355 | A1 | 7/2011 | Ohmi et al. | |

FOREIGN PATENT DOCUMENTS

| | | | |
|---|---|---|---|
| EP | 1820882 | A1 * | 8/2007 |
| GB | 2237030 | A | 4/1991 |
| GB | 2386907 | A | 10/2003 |
| JP | 5302175 | A | 11/1993 |
| JP | 2003220361 | A | 8/2003 |
| RU | 2038428 | C1 | 6/1995 |
| WO | WO-2001053570 | A1 | 7/2001 |
| WO | WO-2009053670 | A2 | 4/2009 |
| WO | WO-2010013705 | A1 | 2/2010 |

OTHER PUBLICATIONS

Srinivasan et al., Surface Engineering 2010, vol. 26, No. 5, pp. 367 to 370.

Blawert et al., Role of sintering and clay particle additions on coating information during PEO processing of AM50 magnesium alloy, Surface & Coatings Technology, 213:48-58 (2012).

European Search Report in Application No. EP 12163197.2, dated Apr. 10, 2014.

* cited by examiner

PROCESS FOR PRODUCING A COATING ON THE SURFACE OF A SUBSTRATE BASED ON LIGHTWEIGHT METALS BY PLASMA-ELECTROLYTIC OXIDATION

CROSS-REFERENCE TO RELATED APPLICATION

The present application claims the benefit of priority of German Application No. 10 2011 007 424.4 filed Apr. 14, 2011. The entire text of the priority application is incorporated herein by reference in its entirety.

The present invention relates to a process for producing a coating on the surface of a substrate by plasma-electrolytic oxidation.

BACKGROUND OF THE INVENTION

The plasma-electrolytic oxidation of surfaces of lightweight metals is a known process. It produces predominantly hard, ceramic layers which offer corrosion protection and wear protection. A prerequisite for plasma-electrolytic oxidation is the formation of an oxide layer (dielectric) in an electrolyte. Maintenance of a current can thus lead to an increase in voltage and discharges. In this way, the surface of lightweight metal parts is converted into a ceramic matrix. This usually requires an electric potential of at least 250 V, which brings about a spark discharge at the surfaces of the parts; local plasma formation occurs. The layers are formed by means of microdischarges which melt the substrate material and reaction products of the electrolyte with the lightweight metal and sinter to form a crystalline ceramic. Alkali silicate or phosphate solutions are predominantly used as electrolyte.

The production of coatings on lightweight metal components by plasma-electrolytic oxidation is described, for example, in C. Blawert et al., Advanced Engineering Materials 2006, 8, No. 6, pages 511 to 533, which is hereby incorporated by reference.

Particles have also for some time been incorporated in the layers. For example, Srinivasan et al., Surface Engineering 2010, Vol. 26, No. 5, pages 367 to 370, describe the coating of magnesium alloys of the AM50 type in alkaline phosphate solutions with addition of $TiO_2$ sol. These particles are incorporated and (partially) crystalline layers are formed.

SUMMARY OF THE INVENTION

It is an object of the present invention to achieve an improvement in corrosion protection for substrates composed of lightweight metals or lightweight metal alloys, in particular magnesium or magnesium alloys.

The object is achieved by a process for producing a coating on the surface of a substrate based on lightweight metals by plasma-electrolytic oxidation, in which the substrate is dipped as electrode together with a counterelectrode into an electrolyte liquid and a sufficient electric potential for generating spark discharges at the surface of the substrate is applied, wherein the electrolyte comprises clay particles dispersed therein. It has been found that amorphous, vitreous oxide layers can be produced on lightweight metals or lightweight metal alloys when clay particles are used.

DETAILED DESCRIPTION OF THE INVENTION

Clay materials are well known in industry. The term clay refers to sheet silicates which have a sheet-like crystal structure. The sheet silicates which are preferably used are selected from the group consisting of vermiculite, talc and smectites, where the smectites are, in particular, sodium montmorillonite, magnesium montmorillonite, calcium montmorillonite, aluminum montmorillonite, nontronite, beidellite, volkonskoite, hectorite, saponite, sauconite, sobockite, stevensite, svinfordite and/or kaolinite.

For the purposes of the present invention, sheet silicates are preferably 1:1 and 2:1 sheet silicates. In these systems, sheets of $SiO_4$ tetrahedra are joined in a regular manner with sheets of $M(O,OH)_6$ octahedra. M is a metal ion such as Al, Mg, Fe. In the 1:1 sheet silicates, a layer of tetrahedra and a layer of octahedra are respectively joined to one another. Examples are kaolin and serpentine minerals.

In the case of 2:1 three-sheet silicates, two sheets of tetrahedra are respectively combined with one sheet of octahedra. If not all octahedral sites are occupied by cations having the charge necessary to compensate the negative charge of the $SiO_4$ tetrahedra and of the hydroxide ions, charged sheets occur. This negative charge is balanced by the incorporation of monovalent cations such as potassium, sodium or lithium or divalent cations such as calcium in the space between sheets. Examples of 2:1 sheet silicates are talc, vermiculites and smectites, including, inter alia, montmorillonite and hectorite.

The clays preferably have an average particle size (by volume) of from 1 nm to 100 μm, more preferably from 10 nm to 20 μm and most preferably from 50 nm to 15 μm. Many methods of determining the particle size are known. One customary method of determining the particle size is laser light scattering. Here, the particles to be measured are irradiated with laser light and scattering rings formed by the radiation of the particles are detected. Laser light scattering utilizes the fact that the size of the scattering angle is inversely proportional to the size of the particle.

A preferred clay can be obtained under the name "Cloisite® Na+" from Southern Clay Products, Inc (Texas, U.S.A.). Typically, more than 90% of the particles have a particle size of less than 15 μm and more than 50% have a particle size of less than 7.5 μm. Another preferred clay can be obtained under the name Nanofil® 116 from Southern Clay Products, Inc (Texas, U.S.A.) having an average particle size of about 12 μm.

Preference is given to using an aqueous electrolyte, more preferably an aqueous, alkaline electrolyte. This preferably contains NaOH, KOH, $Mg(OH)_2$, $Ca(OH)_2$ and/or ammonia. The use of NaOH or $NH_4OH$ is preferred.

The electrolyte preferably additionally contains phosphates and/or further silicates which are not clay materials. Preference is given to using phosphates such as $Na_3PO_4$, $K_3PO_4$, $Mg_3(PO_4)_2$ and/or $Ca_3(PO_4)_2$ or silicates such as $Na_4SiO_4$, $K_4SiO_4$, $Mg_2SiO_4$ and/or $Ca_2SiO_4$. Vitreous layers which in terms of composition resemble bioglasses are formed in phosphate-containing electrolytes. The substrates therefore have increased biocompatibility and are suitable, for example, for use in bioimplant substrates. In silicate-containing electrolytes the layers are likewise amorphous and are suitable for layers in industrial applications. The amorphous layers display improved long-term stability and altered properties (e.g. wettability) under corrosive attack.

The term "vitreous", "vitreous alloy" or "metallic glass" is well known in industry and refers to an amorphous alloy having the characteristic that it does not form a crystal structure and the material remains in a type of arrangement without periodicity, i.e. without long-range order, similarly to the atoms in a melt.

To carry out the plasma-electrolytic oxidation of the substrate, a sufficient electric potential or current for generating spark discharges is applied to the surface of the substrate (breakdown voltage). A constant current density is preferably employed, and the voltage is thus increased continuously during coating in order to compensate for the increasing resistance (increasing layer thickness). Preference is given to applying an initial breakdown voltage of at least 200 V, preferably at least 230 V, more preferably at least 250 V. The final voltage is preferably at least 500 V, more preferably at least 520 V.

Preference is given to applying a pulsed voltage. The pulse time is preferably from 1 ms to 10 ms, more preferably from 2 ms to 5 ms, with the intervals between the pulses preferably being from 1 ms to 100 ms, more preferably from 10 ms to 30 ms. The current density should preferably be from 10 mA $cm^{-2}$ to 50 mA $cm^{-2}$, more preferably from 20 mA $cm^{-2}$ to 40 mA $cm^{-2}$ and most preferably from 25 mA $cm^{-2}$ to 35 mA $cm^{-2}$.

The temperature of the electrolyte is preferably from 20° C. to 30° C. The duration of the electrolysis is preferably from 1 minute to 60 minutes, more preferably from 5 minutes to 20 minutes.

Selection of the voltage, current density and treatment or processing time enables the properties of the coating, e.g. coating thickness, to be varied and matched to the desired purpose. A person skilled in the art will be able to set the necessary parameters on the basis of general technical knowledge.

Furthermore, the properties of the coatings can be set by variation of the particle concentration. The concentration of clay particles in the electrolyte is preferably from 1% by weight to 10% by weight, more preferably from 2% by weight to 5% by weight, based on the total weight of the electrolyte.

As substrate materials, preference is given to using magnesium, aluminum, titanium or alloys thereof. The substrate material is most preferably magnesium or an alloy thereof. The magnesium alloy of the magnesium substrate can contain any amount, e.g. from 1 to 100 atom % (at. %), of magnesium. The magnesium alloy of the magnesium component preferably contains at least 50 at. %, particularly preferably at least 70 at. %, magnesium. It is preferred, but not necessary, for the magnesium alloy also to contain at least one element selected from the group consisting of the elements of main group 3, transition group 3 and the rare earth elements of the Periodic Table. For example, the magnesium substrate can be made of a AZ31, AZ91, AE42, ZM21, ZK31, ZE41 alloy or any other conventional magnesium alloy.

Surface coatings having improved corrosion protection or improved biocompatibility and the possibility of controlling the degradation of the substrate better are achieved on substrates based on lightweight metals by means of the process of the invention.

Substrates can therefore be any machine components, automobile components, railroad components, aircraft components, ships' components, etc., or bioimplants such as bone replacement materials or medical bone screws made of a lightweight metal such as magnesium or a magnesium alloy.

EXAMPLES

An AM50 test specimen having a size of 15 mm×15 mm×4 mm and a proportion by mass of 4.4%~5.5% of Al, 0.26%~0.6% of Mn, not more than 0.22% of Zn, not more than 0.1% of Si and Mg as balance was used as substrate for the following example. The substrates were ground in succession with abrasive paper of the size grade 500, 800, 1200 and 2500 and subsequently cleaned with ethanol.

The silicate-based electrolyte was produced using $Na_2SiO_3$ (10.0 g/l) and KOH (1.0 g/l) in the distilled water and the phosphate-based electrolyte was produced using $Na_3PO_4$ (10.0 g/l) and KOH (1.0 g/l) in distilled water. Up to 10 g/l of clay particles (Rockwood Nanofil® 116) having an average particle size of 12 μm were dispersed in these electrolytes to produce the nanoparticle-containing electrolytes.

The plasma-electrolytic oxidation was carried out using a pulsed DC voltage source, with the pulse ratio $t_{on}$:$t_{off}$ being 2 ms:20 ms. The plasma electrolysis was in each case carried out for 30 minutes at a constant current density of 15 mA/$cm^{-2}$ both in the silicate-based electrolyte and in the phosphate-based electrolyte, in each case with and without addition of clay particles. The temperature of the electrolyte was maintained at 10° C.±2° C. by means of a water cooling system.

All coated specimens were rinsed with distilled water immediately after the plasma electrolysis and dried in ambient air.

The test specimens which had been coated by plasma electrolysis were examined in a Cambridge Stereoscan 200 Electron microscope. X-ray diffraction (XRD) using Cu—$K_\alpha$ radiation was carried out to determine the phase composition.

The structure of the coating was assessed by means of TEM. The TEM test specimens were produced by removing a section from the coating which extended to the interface of the substrate by means of FIB (focused ion beam).

Electrochemical studies were carried out to determine the corrosion behavior of coated and PEO-coated test specimens by means of a Gill AC potentiostat. A typical three-electrode cell having a saturated Ag/AgCl electrode (saturated with KCl) as reference electrode, a platinum gauze counterelectrode (0.5 $cm^2$) and the specimens as working electrode was used. The electrochemical studies were carried out in 0.1M NaCl solution.

Macroscopic studies on the morphology of the corroded surface of the test specimens were carried out using an optical stereomicroscope and in the Cambridge Stereoscan 250 electron microscope.

Example 1

PEO Coating Produced Using a Phosphate-Based Electrolyte

The scanning electromicrographs show that the surface of the test specimen produced by means of PEO using a phosphate-based electrolyte (without clay particles) has micropores having a diameter of 10-30 μm. The pore-free region is, on the other hand, smooth. Many small particles were observed on the surface of the test specimen produced by means of PEO using a phosphate-based electrolyte containing 10 g/l of clay particles; the surface was rough. The size of the small particles varied from a few hundred nm to some mm. Images of the cross section showed that the thickness (20 μm±2 μm) of the coating produced using clay particles was smaller than the thickness (25 μm±2 μm) of the coating produced without clay particles. Many more pores were also observed in the coating produced using clay particles.

A further interesting result is that the hydrophilicity of the two PEO-coated test specimens is different. The test specimen produced by means of PEO using a phosphate-based electrolyte without clay particles is hydrophilic when the water contact angle is less than 90°. In the case of the test specimen produced by means of PEO using a phosphate-based electrolyte with clay particles, the water droplet spreads quickly and immediately covers the surface. This means that the test specimens produced by means of PEO using a phosphate-based electrolyte with clay particles are superhydrophilic.

It can be seen from table 1 that the $i_{corr}$ of the test specimen produced by means of PEO using a phosphate-based electrolyte with clay particles is only slightly below that of the test specimen produced by means of PEO using a phosphate-based electrolyte without clay particles.

TABLE 1

| Test specimen | $E_{corr}$ (mV) | $i_{corr}$ (mA/cm$^2$) | $E_{bd}$ (mV) |
|---|---|---|---|
| Uncoated Mg alloy | −1460 ± 10 | (2.0 ± 0.5) × $10^{-2}$ | — |
| P-PEO-coated Mg alloy | −1555 ± 25 | (6.8 ± 2.5) × $10^{-5}$ | −1390 ± 10 |
| P-PEO-coated Mg alloy with clay particles | −1520 ± 30 | (4.1 ± 1.7) × $10^{-5}$ | −1415 ± 20 |

Figure 1:
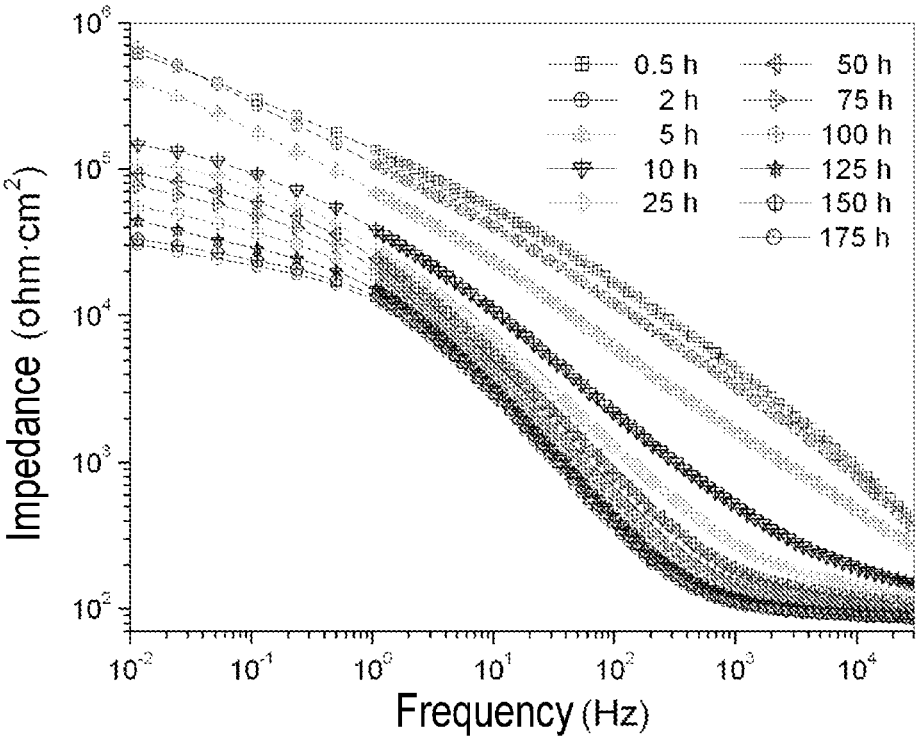
FIG. 1 shows the result of an examination by electrochemical impedance spectroscopy of a test specimen produced by means of PEO using a phosphate-based electrolyte without clay particles after immersion for different times in 0.1M NaCl solution.
Figure 2:
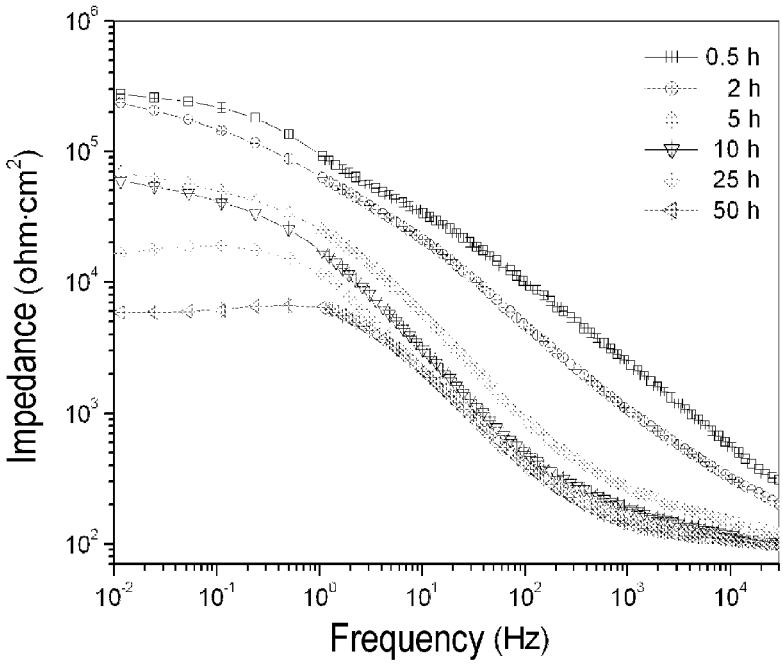
FIG. 2 shows the result of an examination by electrochemical impedance spectroscopy of a test specimen produced by means of PEO using a phosphate-based electrolyte with clay particles after immersion for different times in 0.1M NaCl solution.

The examination by electrochemical impedance spectroscopy showed that the test specimens produced by means of PEO using a phosphate-based electrolyte without clay particles failed after only 50 h in 0.1M NaCl solution (FIG. 1), while the test specimens produced by means of PEO using a phosphate-based electrolyte with clay particles survived for more than 175 hours in 0.1M NaCl solution (FIG. 2).

Example 2

PEO Coating Produced Using Silicate-Based Electrolyte

The scanning electromicrographs show that the surface of the test specimen produced by means of PEO using a silicate-based electrolyte (without clay particles) has a larger number of micropores having a diameter of 5-15 μm. The pore-free region, on the other hand, is smooth without any heterogeneous particles. Many small particles were observed on the surface of the test specimen produced by means of PEO using a silicate-based electrolyte containing 10 g/l of clay particles. Micrographs of the cross section showed that the thickness of the coating produced with clay particles and the coating produced without clay particles were about the same (17 μm±3 μm). Many more pores were also observed in the coating produced with clay particles.

As in example 1, it is found the hydrophilicity of the two PEO-coated test specimens is different. The test specimen produced by means of PEO using a silicate-based electrolyte without clay particles is hydrophilic when the water contact angle is less than 90°. In the case of the test specimen produced by means of PEO using a silicate-based electrolyte with clay particles, the water droplet spreads quickly and immediately covers the surface and the contact angle is obviously much lower.

It can be seen from table 2 that the $i_{corr}$ of the test specimen produced by means of PEO using a silicate-based electrolyte with clay particles is an order of magnitude above that of the test specimen produced by means of PEO using a silicate-based electrolyte without clay particles.

TABLE 2

| Test specimen | $E_{corr}$ (mV) | $i_{corr}$ (mA/cm$^2$) | $E_{bd}$ (mV) |
|---|---|---|---|
| Uncoated Mg alloy | −1460 ± 10 | (2.0 ± 0.5) × $10^{-2}$ | — |
| Si-PEO-coated Mg alloy | −1430 ± 25 | (4.5 ± 2.5) × $10^{-6}$ | −1150 ± 40 |
| Si-PEO-coated Mg alloy with clay particles | −1465 ± 50 | (4.8 ± 0.6) × $10^{-5}$ | −1230 ± 25 |

Figure 3:
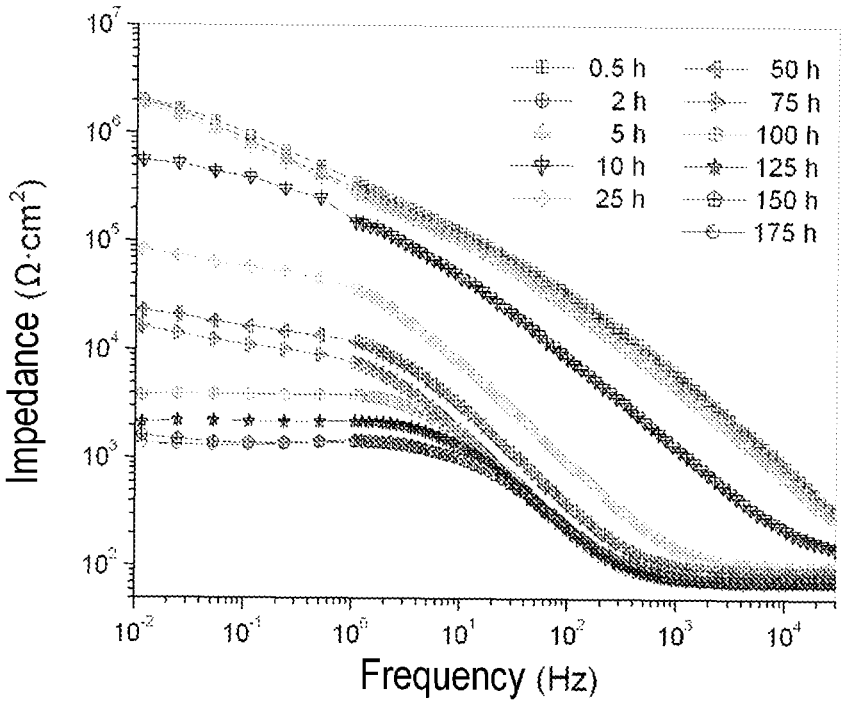
FIG. 3 shows the result of an examination by electrochemical impedance spectroscopy of a test specimen produced by means of PEO using a silicate-based electrolyte without clay particles after immersion for different times in 0.1M NaCl solution.
Figure 4:
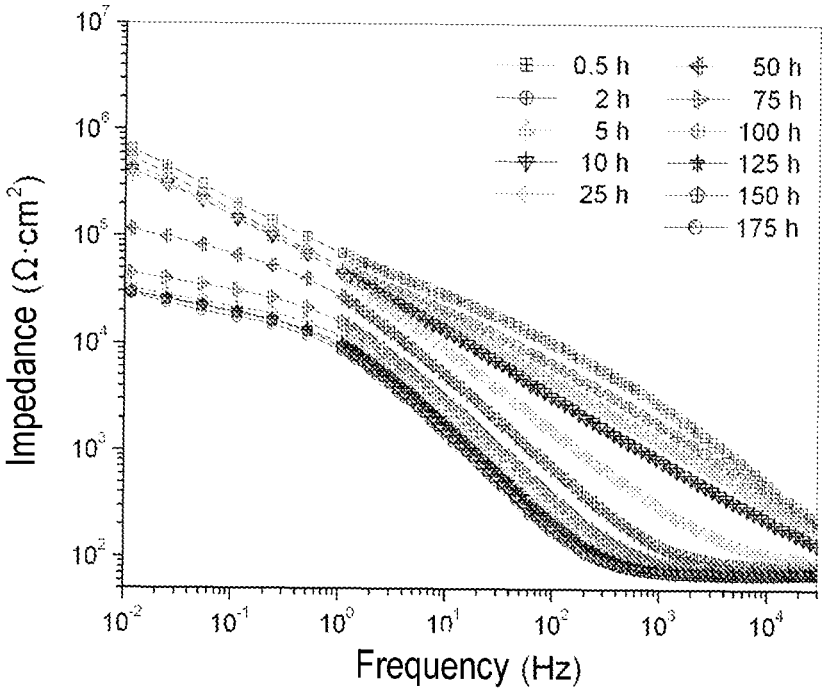
FIG. 4 shows the result of an examination by electrochemical impedance spectroscopy of a test specimen produced by means of PEO using a silicate-based electrolyte with clay particles after immersion for different times in 0.1M NaCl solution.

The examination by electrochemical impedance spectroscopy showed that the test specimens produced by means of PEO using silicate-based electrolyte without clay particles failed after only 100 h in 0.1M NaCl solution (FIG. 3), while the test specimens produced by means of PEO using a silicate-based electrolyte with clay particles survived for more than 175 hours in 0.1M NaCl solution (FIG. 4).

X-ray diffraction (XRD) studies make it obvious that the coating structure changes from crystalline to amorphous when clay particles are added to the electrolyte. The sharp XRD peaks of the crystalline layer gradually disappear on addition of 3 g/l, 6 g/l and 10 g/l of clay particles and the typical broad diffraction spectrum of a vitreous material is obtained. The peaks are due to the Mg substrate under the layer. This finding was confirmed by TEM studies.

The compositions of the coatings were determined by means of EDX analysis and are shown in table 3 below.

TABLE 3

| At. % | O | Na | Mg | Al | Si | P | C | Fe |
|---|---|---|---|---|---|---|---|---|
| P-PEO | 50 | 7 | 27 | 0 | 0 | 12 | 4 | 0 |
| +3 g/l of clay | 50 | 6 | 18 | 2 | 7 | 8 | 7 | 1 |
| +10 g/l of clay | 50 | 6 | 11 | 5 | 15 | 6 | 6 | 2 |
| Si-PEO | 47 | 4 | 21 | 1 | 18 | 0 | 10 | 0 |
| +10 g/l of clay | 50 | 4 | 11 | 4 | 23 | 0 | 6 | 2 |

Table 3 makes it obvious that the compositions of the coatings resemble those of bioglasses (mixed from $Na_2O$, MgO, CaO, $SiO_2$, $Al_2O_3$, $P_2O_5$). Only Ca is missing as a typical constituent. Similar biomedical applications can therefore be expected. However, Ca can also be added in the form of $Ca(OH)_2$ to the electrolyte so that it can also be introduced into the coating.

The invention claimed is:

1. A method for producing a coating on the surface of a substrate wherein the coating is an amorphous, vitreous oxide layer based on lightweight metals by plasma-electrolytic oxidation, in which the substrate is dipped as an electrode together with a counter electrode into an electrolyte liquid and applying an electric potential sufficient for generating spark discharges at the surface of the substrate, wherein the electrolyte comprises clay particles dispersed therein.

2. The method as claimed in claim 1, wherein the light-weight metal is selected from the group consisting of magnesium, aluminum, titanium, beryllium and alloys thereof.

3. The method as claimed in claim 2, wherein the light-weight metal is magnesium or an alloy thereof.

4. The method as claimed in claim 1, wherein the clay particles have a size of from 1 nm to 100 μm.

5. The method as claimed in claim 4, wherein the clay particles have a size of from 10 nm to 20 μm.

6. The method as claimed in claim 5, wherein the clay particles have a size of from 50 nm to 15 μm.

7. The method as claimed in claim 1, wherein the electrolyte additionally contains phosphates and/or silicates.

8. The method as claimed in claim 2, wherein the electrolyte additionally contains phosphates and/or silicates.

9. The method as claimed in claim 3, wherein the electrolyte additionally contains phosphates and/or silicates.

10. The method as claimed in claim 4, wherein the electrolyte additionally contains phosphates and/or silicates.

11. The method as claimed in claim 5, wherein the electrolyte additionally contains phosphates and/or silicates.

12. The method as claimed in claim 6, wherein the electrolyte additionally contains phosphates and/or silicates.

* * * * *

UNITED STATES PATENT AND TRADEMARK OFFICE

CERTIFICATE OF CORRECTION

PATENT NO. : 8,828,215 B2
APPLICATION NO. : 13/438418
DATED : September 9, 2014
INVENTOR(S) : Carsten Blawert et al.

It is certified that error appears in the above-identified patent and that said Letters Patent is hereby corrected as shown below:

On the title page, item (75), under "Inventors", in Column 1, Line 6

Daniel Hoche, Hamburg (DE) should be

--Daniel Höche, Hamburg (DE)--

Signed and Sealed this
Seventeenth Day of March, 2015

Michelle K. Lee

Michelle K. Lee
*Director of the United States Patent and Trademark Office*